US011768036B2

(12) United States Patent
Ingenito et al.

(10) Patent No.: US 11,768,036 B2
(45) Date of Patent: Sep. 26, 2023

(54) HEAT EXCHANGER AND SYSTEM FOR COOLING A FLUID COMPRISING SUCH A HEAT EXCHANGER

(71) Applicant: LIEBHERR-AEROSPACE TOULOUSE SAS, Toulouse (FR)

(72) Inventors: Johanna Ingenito, Toulouse (FR); Romain Angélique, Toulouse (FR); Florian Bonnivard, Toulouse (FR); Mickael Bregoli, Toulouse (FR); Grégoire Hanss, Toulouse (FR); Jérome Rocchi, Toulouse (FR)

(73) Assignee: LIEBHERR-AEROSPACE TOULOUSE SAS, Toulouse (FR)

( * ) Notice: Subject to any disclaimer, the term of this patent is extended or adjusted under 35 U.S.C. 154(b) by 239 days.

(21) Appl. No.: 17/298,536

(22) PCT Filed: Nov. 22, 2019

(86) PCT No.: PCT/FR2019/052781
§ 371 (c)(1),
(2) Date: May 28, 2021

(87) PCT Pub. No.: WO2020/109707
PCT Pub. Date: Jun. 4, 2020

(65) Prior Publication Data

US 2022/0011049 A1 Jan. 13, 2022

(30) Foreign Application Priority Data

Nov. 28, 2018 (FR) ..... 1871990

(51) Int. Cl.
*F28D 7/10* (2006.01)
*F28D 21/00* (2006.01)

(52) U.S. Cl.
CPC ..... *F28D 7/106* (2013.01); *F28D 2021/0021* (2013.01); *F28F 2210/02* (2013.01)

(58) Field of Classification Search
CPC ..... F28D 7/106; F28D 2021/0021; F28F 2210/02
(Continued)

(56) References Cited

U.S. PATENT DOCUMENTS 4,307,578 A * 12/1981 Ecker ..... F25B 13/00 165/157
4,440,217 A 4/1984 Stieler
(Continued)

FOREIGN PATENT DOCUMENTS

WO WO2017029211 2/2017

*Primary Examiner* — Davis D Hwu
(74) *Attorney, Agent, or Firm* — CRGO Global; Steven M. Greenberg

(57) ABSTRACT

A tubular heat exchanger (10) comprising: a fluid circulation chamber (20) intended to be supplied with a first fluid, referred to as outer fluid, brought to a first temperature, a heat exchange matrix (30) housed in said circulation chamber and formed by a plurality of heat exchange tubes (31) each comprising at least one pair of ducts (32; 33) nested one inside the other, extending along a direction, referred to as longitudinal direction, and defining: a channel for circulating a fluid, referred to as inner channel (32*c;* 33*c*), suitable for being able to be supplied with a second fluid, referred to as inner fluid, brought to a second temperature, and a channel for the circulation of a fluid, referred to as intermediate channel (32*d;* 33*d*), and suitable for being able to be supplied with a third fluid, referred to as intermediate fluid, brought to a third temperature, different from said first temperature.

12 Claims, 3 Drawing Sheets

(58) Field of Classification Search
USPC ..... 165/154
See application file for complete search history.

(56) References Cited

U.S. PATENT DOCUMENTS

| | | | | |
|---|---|---|---|---|
| 5,403,281 | A * | 4/1995 | O'Neill | A61M 5/44<br>604/113 |
| 2003/0218333 | A1* | 11/2003 | Barber | F28F 9/22<br>285/382.4 |
| 2013/0206374 | A1 | 8/2013 | Roisin et al. | |
| 2016/0202003 | A1 | 7/2016 | Gerstler et al. | |
| 2017/0001943 | A1 | 1/2017 | Singh et al. | |

* cited by examiner

HEAT EXCHANGER AND SYSTEM FOR COOLING A FLUID COMPRISING SUCH A HEAT EXCHANGER

CROSS-REFERENCE TO RELATED APPLICATIONS

This application is a § 371 national phase entry of International Application No. PCT/FR2019/052781, filed Nov. 22, 2019, which claims priority to French Patent Application No. 1871990, filed Nov. 28, 2018.

TECHNICAL FIELD OF THE INVENTION

The invention relates to a heat exchanger, in particular a tubular heat exchanger for an air or rail transport vehicle. The invention also relates to a system for cooling a fluid comprising such a heat exchanger. The invention also relates to an air conditioning system for a cabin of an air or rail transport vehicle equipped with such a cooling system.

TECHNICAL BACKGROUND

An environmental control system for an aircraft cabin, better known by the acronym ECS for "Environmental Control System," is intended to provide the cabin of the aircraft (which generally refers to any interior space of the aircraft, the pressure and/or temperature of the air of which must be controlled, such as a passenger cabin, the cockpit, a hold, etc.) with air at controlled pressure and/or temperature.

To do this, it is known practice to take high-pressure air from the propulsion engines of the aircraft and to treat this air using a plurality of devices to bring it to a temperature and pressure which are compatible with the needs of the cabin.

Among these equipment items, there is at least one air/air heat exchanger which aims to cool the air taken from the propulsion engines of the aircraft by implementing heat exchanges between this hot air flow and a cold air flow.

Thus, such a heat exchanger generally comprises a hot circuit and a transverse cold circuit which are configured to be able to ensure heat exchanges between the air flow conveyed by the hot circuit (also referred to hereinafter as the hot pass) and the cold air flow conveyed by the cold circuit (also referred to hereinafter as the cold pass).

The cold circuit can, for example, be supplied by an air flow taken from the secondary flow of the engine, known by the name of fan air, the temperature of which is close to the external environment of the aircraft, and which can therefore reach temperatures in flight in the order of −50° C. and a pressure in the order of 200 mbar.

The cold circuit can also be supplied by an air flow taken from a scoop of the aircraft which supplies an air channel, better known under the name of RAM air.

The hot circuit can be supplied directly by the air taken from the propulsion engines or by air coming from the engines and already partially treated by equipment upstream of the air conditioning system.

In the case of electric air conditioning systems, the hot circuit can be supplied by air taken from outside the aircraft and compressed by suitable compressors.

Most of the heat exchangers used today on board aircraft consist of fin or plate heat exchangers. These exchangers are formed by a heat exchange chamber of generally rectangular shape and comprise stacked layers of fins, for example corrugated, which form stacked circulation channels which extend alternately in directions that are perpendicular from one layer to the other. Thus, the hot pass which supplies one face of the exchanger circulates in the channels of the different layers and the cold pass which supplies a perpendicular face of the exchanger circulates in the transverse channels interposed between two channels of the hot pass. This architecture makes it possible to insert each hot channel between two cold channels over the entire length of the exchanger and therefore to ensure heat exchanges between the two fluids.

International application WO201802171 in the name of the applicant describes such a heat exchanger.

These heat exchangers make it possible to cool the air taken from the engines or the ambient air compressed by dedicated compressors, before being treated by the other equipment of the air conditioning system in order to be able to supply the cabin of the aircraft. The cooling capacity of an exchanger is directly proportional to its size.

However, the size and weight of a heat exchanger are two critical characteristics for aircraft manufacturers, who are constantly seeking to limit the weight and volume of the exchanger as much as possible while aiming for high cooling performance.

The inventors therefore sought a new solution making it possible to increase the exchange surfaces within the exchanger while limiting the size of the exchanger as much as possible.

The inventors have sought in particular to develop a heat exchanger which can be used not only in the context of the air conditioning systems of a transport vehicle, such as an aircraft, but also in all types of cooling systems requiring the cooling of a hot fluid from a hot fluid source by a cold fluid from a cold fluid source.

As such, the invention is not limited only to heat exchangers intended for air conditioning systems, but also to heat exchangers intended for all types of heat exchange applications.

AIMS OF THE INVENTION

The invention aims to provide a heat exchanger which overcomes at least some of the drawbacks of the known solutions.

The invention aims in particular to provide, in at least one embodiment, a heat exchanger which makes it possible to optimize the exchange surfaces.

The invention also aims to provide, in at least one embodiment, an exchanger which has a reduced size compared to existing heat exchangers.

The invention also aims to provide, in at least one embodiment, an exchanger with reduced pressure drops.

The invention also aims to provide, in at least one embodiment, an exchanger which can be embedded in a fluid circulation duct in order to functionalize such a duct and thus reduce the size of the system.

The invention also aims to provide a system for cooling a hot fluid by a cold fluid equipped with a heat exchanger according to the invention.

The invention also aims to provide an air conditioning system equipped with a heat exchanger according to the invention.

The invention also aims to provide an air or rail transport vehicle equipped with an air conditioning system according to the invention.

DISCLOSURE OF THE INVENTION

To do this, the invention relates to a heat exchanger comprising:

a fluid circulation chamber comprising a fluid inlet and a fluid outlet intended to be supplied with a first fluid, referred to as outer fluid, brought to a first temperature, a heat exchange matrix housed in said circulation chamber and formed by a plurality of heat exchange tubes each comprising at least one pair of ducts nested one inside the other, referred to as inner duct and outer duct, respectively, extending along a direction, referred to as longitudinal direction, and defining:

a channel for the circulation of a fluid, referred to as inner channel, delimited by said inner duct, and suitable for being able to be supplied with a second fluid, referred to as inner fluid, brought to a second temperature, and a channel for the circulation of a fluid, referred to as intermediate channel, delimited by the inter-duct space between said inner duct and said outer duct, and suitable for being able to be supplied with a third fluid, referred to as intermediate fluid, brought to a third temperature, different from said first temperature.

The heat exchanger according to the invention is characterized in that at least one heat exchange tube—in particular each heat exchange tube—comprises at least two pairs of nested ducts, said pairs being connected to each other by at least one transverse spacer.

A heat exchanger according to the invention has a particular configuration with a heat exchange matrix formed by a plurality of heat exchange tubes housed in a fluid circulation chamber, of which at least one heat exchange tube comprises at least two pairs of ducts nested one inside the other. Such a heat exchange matrix configuration has the advantage of having a double heat exchange surface and thus increasing the heat exchange surfaces while reducing the size of said heat exchanger.

More particularly, a heat exchanger according to the invention comprises a chamber in which a fluid brought to a first temperature circulates. A plurality of heat exchange tubes each comprising at least one pair of ducts nested one inside the other is arranged in this chamber. Each tube comprises at least one pair of ducts defined by an inner duct housed in an outer duct delimiting an inner channel and an inter-duct intermediate channel, respectively. Also, each channel (the inner channel and the intermediate channel, respectively) can be supplied with a dedicated fluid.

According to the invention, said outer and inner ducts are nested one inside the other in order to allow the intermediate fluid to circulate in the intermediate channel delimited by the inter-duct space and the inner fluid to circulate in the inner channel delimited by the inner duct. The inner duct forms the heat exchange surface between the inner fluid and the intermediate fluid while the outer duct forms the heat exchange surface between the outer fluid supplying the chamber and the intermediate fluid. The nested ducts therefore form a double heat exchange surface for the intermediate fluid.

Thus, the intermediate fluid circulating in the intermediate duct can be heated or cooled (depending on the temperatures of the inner, intermediate and outer fluids) both by the inner fluid circulating in the inner channel and by the outer fluid circulating in the fluid circulation chamber. This double heat exchange permitted by the particular structure of the exchanger according to the invention therefore makes it possible to cool and/or heat the intermediate fluid with better efficiency than the systems of the prior art.

According to the invention, the configuration of the nested ducts not only makes it possible to form a double heat exchange zone, but also to reduce the size of the exchanger. In particular, the double heat exchange has the advantage of reducing the number of heat exchange tubes within an exchanger while benefiting from an exchange surface equivalent to that of an existing exchanger. The exchanger according to the invention makes it possible to increase the exchange surface compared to an existing exchanger and therefore to obtain a more efficient heat exchanger with equivalent size, or to obtain a reduced size with equivalent performance.

According to the invention, said inner and outer fluids intended to supply said inner channel of a pair of nested ducts and said fluid circulation chamber, respectively, come from the same fluid source.

Thus, said outer and inner fluids are of the same nature and can be brought to the same temperature. The inner and outer fluids thus enclose the intermediate fluid circulating in the intermediate channel. The intermediate fluid therefore undergoes heat exchanges of the same nature, both at the inner wall delimited by the inner duct and at the outer wall delimited by the outer duct.

Furthermore, according to the invention, the outer and inner fluid is the cold pass fluid and the intermediate fluid is the hot pass fluid. The cold pass thus makes it possible to cool the hot pass by circulating around it in the chamber and also in the center of the hot pass by circulating in the inner duct delimiting the inner channel.

The intermediate fluid is thus cooled more efficiently, given that said nested ducts delimiting the inter-duct space in which the intermediate fluid can circulate are both in contact with a fluid brought to a lower temperature. In this case, the cooling of the intermediate fluid is facilitated and the cooling efficiency of said fluid is improved.

According to the invention, the inner channel can communicate with said fluid circulation chamber such that the fluid circulating in said chamber is the same fluid circulating in said inner channel.

Said inner duct of the heat exchange tube then opens directly into said fluid circulation chamber. Therefore, a single supply system is sufficient to supply both the inner channel and said circulation chamber. Thus, this configuration only requires a single fluid passing through the fluid circulation chamber from the inlet to the outlet while simultaneously supplying said inner channels of the heat exchange tubes.

According to the invention, the transverse spacer, also referred to in the text as "connecting spacer," arranged between the pairs of nested ducts can create turbulence within the fluid circulation chamber, which improves the heat exchanges between the outer fluid circulating in the chamber and the intermediate fluid which circulates in the intermediate channels.

The connecting spacer can also have a heat exchange functionality by conducting at least some of the heat captured from the outer duct to the mixing chamber.

In addition, a tube according to the invention equipped with a spacer is rigid so that a plurality of tubes according to the invention makes it possible, when the tubes are combined with each other, to form a compact matrix network of exchange tubes.

According to a variant of the invention, the inner, intermediate and outer fluid flows are air flows, originating, respectively, from a flow of hot air, for example taken from a propulsion engine of an aircraft, and a flow of cold air, taken, for example, from outside the aircraft.

Advantageously and according to the invention, at least one heat exchange tube—in particular each heat exchange tube—comprises at least two pairs of nested ducts, said intermediate channels of which are supplied by the same intermediate fluid distributor.

According to this advantageous variant, a distributor makes it possible to supply the various pairs of nested ducts of the heat exchange tube.

Such an intermediate fluid distributor is, for example, formed by a tubing comprising an intermediate fluid inlet which splits into a plurality of tubings to form a plurality of sources supplying intermediate fluid to the intermediate channels. In the case where the tube comprises two pairs of nested ducts, the distributor has a fluid inlet and two fluid outlets opening into each of the two intermediate channels of said two pairs of nested ducts.

Preferably, said distributor is generally Y-shaped, the base of the Y forming the inlet of the intermediate fluid into the tube and the two branches of the Y forming supply channels for the intermediate channels.

Each distributor can be connected to the same supply system to facilitate the distribution of intermediate fluid in all the distributors and subsequently in the intermediate channels of the various heat exchange tubes.

In the case where the tube comprises three pairs of nested ducts, the distributor has a fluid inlet and three fluid outlets opening into each of the three intermediate channels of said three pairs of nested ducts. Of course, nothing precludes providing tubes comprising more than three pairs of nested ducts for an equivalent effect.

A distributor according to this variant of the invention therefore makes it possible to supply a plurality of intermediate channels of a plurality of pairs of ducts by a single intermediate fluid supply.

Advantageously and according to the invention, at least one inner duct—in particular each inner duct—of at least one pair of nested ducts—in particular of each pair of nested ducts—passes through said intermediate fluid distributor.

This makes it possible to supply the inner channels either directly by the fluid circulating in the circulation chamber, or by a fluid dedicated to the inner channels, in which case the inner ducts also pass through the outer fluid circulation chamber.

According to this variant, an intermediate fluid supply system can distribute said intermediate fluid in said intermediate channels through distributors. The inner fluid supply can be done by means of a second supply system dedicated to the distribution of said inner fluid which can supply said inner channels, which can extend outside the circulation chamber.

Advantageously and according to the invention, at least one inner duct—in particular each inner duct—of at least one pair of nested ducts—in particular of each pair of nested ducts—passes through said intermediate fluid distributor and opens into said circulation chamber.

According to this variant, the inner ducts open directly into the fluid circulation chamber so that the supply of the fluid circulation chamber also allows the supply of the inner channels delimited by the inner ducts.

Advantageously and according to the invention, at least one transverse spacer—in particular each transverse spacer—comprises at least one opening configured to allow the passage of said outer fluid between said pairs of nested ducts connected by this spacer in a direction having an angle of between 0° and 90° with respect to said longitudinal direction.

According to this variant, said transverse spacer comprises at least one opening to allow better circulation of said outer fluid within the circulation chamber between the pairs of ducts.

According to this variant, the outer fluid is distributed homogeneously in said circulation chamber in order to promote heat exchanges between said outer fluid and said intermediate fluid circulating in the intermediate channel of the tubes.

Advantageously and according to the invention, at least one heat exchange tube—in particular each heat exchange tube—comprises at least one pair of nested ducts, the ducts of which are connected to one another by a connecting rod which extends in the intermediate channel between the inner duct and the outer duct.

According to this variant, the inner and outer ducts which together form a pair of nested ducts of the tube are mechanically connected by at least one connecting rod which extends in the inter-duct space between the ducts to stiffen the assembly thus formed.

Advantageously and according to the invention, at least one heat exchange tube—in particular each heat exchange tube—comprises at least one pair of nested cylindrical ducts.

According to this variant, the ducts are cylindrical. A cylindrical duct is understood in the mathematical sense of the term, that is to say, such a duct is a solid generated by a straight line which moves parallel to itself on a generator. Such a generator can be square, circular, oval, etc.

Preferably, the nested ducts are cylindrical with a circular base.

According to this variant, said cylindrical ducts are optimized to be arranged in a fluid circulation chamber which is preferably also cylindrical with a circular base. In other words, the heat exchanger then forms a cylindrical tubular exchanger which can be embedded in a cylindrical duct. Thus, the tubular heat exchanger comprising a cylindrical chamber can be easily integrated within a cylindrical fluid circulation pipe.

An exchanger according to this variant of the invention, embedded in a cylindrical duct, makes it possible to functionalize this duct, and therefore to limit the size of the exchanger by housing it within an equipment item which is already present, thus freeing up space outside of the duct.

According to this variant, the cylindrical shape of the ducts also makes it possible to reduce the pressure forces exerted on the walls of the nested ducts by the fluids circulating inside and outside the ducts.

The heat exchange tubes of a heat exchanger according to the invention can also have any shape. Thus, the tubes can, for example, be cylindrical, extending in a rectilinear manner along a longitudinal direction, but nothing precludes providing other embodiments in which the tubes are curved, or form spirals, or any other shape.

Advantageously and according to the invention, at least one heat exchange tube—in particular each heat exchange tube—comprises at least one pair of nested concentric ducts.

This advantageous variant makes it possible in particular to homogenize the forces exerted on the ducts and to simplify the operations of nesting the ducts one inside the other.

Advantageously and according to the invention, said heat exchanger further comprises a casing, said casing delimiting the fluid circulation chamber.

According to this variant, the exchanger chamber is delimited by a casing which comprises at least a plurality of tubes arranged in said chamber so that the exchanger is integrated into a pipe, which is preferably cylindrical.

The invention also relates to a system for cooling a fluid exhibiting a first temperature, referred to as hot fluid, with a fluid exhibiting a second temperature, referred to as cold fluid, comprising a hot fluid circuit suitable for being able to be supplied with hot fluid by a hot fluid source, and a cold fluid circuit suitable for being able to be supplied with cold fluid by a cold fluid source.

A cooling system according to the invention is characterized in that it further comprises a heat exchanger according to the invention, said hot circuit supplying said intermediate channels and said cold circuit supplying said inner channels and said circulation chamber of said exchanger.

A cooling system according to the invention can be implemented in all applications requiring cooling of a hot fluid by a cold fluid (cooling of electronics by a heat transfer fluid; cooling of air taken from a propulsion engine for an air conditioning system, etc.). The fluids can be of the same nature (air/air or liquid/liquid) or of a different nature (air/liquid or liquid/air).

The advantages of a heat exchanger according to the invention apply, mutatis mutandis, to a cooling system according to the invention.

Advantageously and according to the invention, said intermediate channels and said inner channels are supplied counter-currently by said hot and cold circuits, respectively.

According to this variant, the inner fluid circulates in the inner channel of each tube against the current of the intermediate fluid which circulates in the intermediate channel of each tube, that is to say, the fluids each circulate in opposite directions. As a variant or in combination, the outer fluid can also circulate against the current of said intermediate fluid.

The invention also relates to an air conditioning system of a cabin of a transport vehicle comprising at least one air cooling system according to the invention.

According to this variant, the hot air circuit is, for example, supplied with air taken from a propulsion engine of the aircraft and said cold air circuit is, for example, taken from the secondary flow of the engine of the aircraft or from outside the aircraft.

Of course, nothing precludes the use of an exchanger according to the invention by providing that the hot fluid is not taken from the propulsion engines of the aircraft, which may, for example, be the case in the context of electrical air conditioning systems for which the hot air is obtained by means of compressing the air taken from outside the aircraft.

The invention also relates to an air, rail or automotive transport vehicle comprising at least one propulsion engine, a cabin and at least one air-conditioning system for said cabin, characterized in that the air conditioning system of the cabin is an air conditioning system according to the invention.

The advantages of an air conditioning system according to the invention apply, mutatis mutandis, to a transport vehicle according to the invention.

The invention also relates to a heat exchanger, a system for cooling a fluid, an air conditioning system, and an aircraft, characterized in combination by all or some of the features mentioned above or below.

LIST OF FIGURES

Further aims, features and advantages of the invention will become apparent upon reading the following description, which is provided solely by way of non-limiting example, and which refers to the accompanying figures, in which.

Figure 3A:
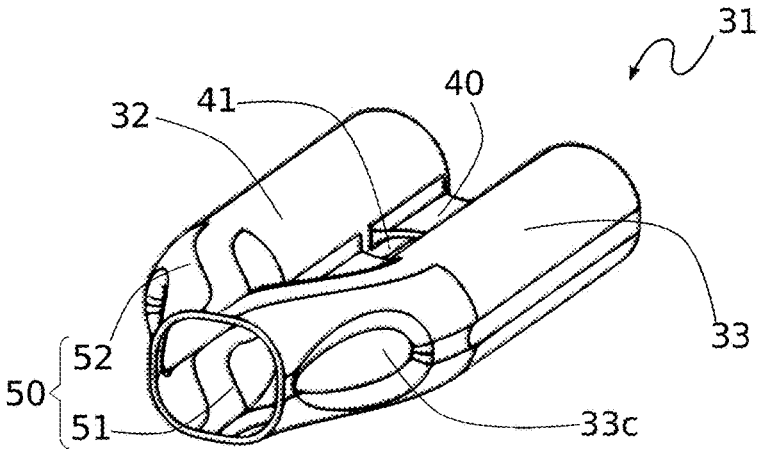

FIG. 3*a* is a schematic front perspective view of a tube of an exchanger according to one embodiment of the invention.

Figure 3B:
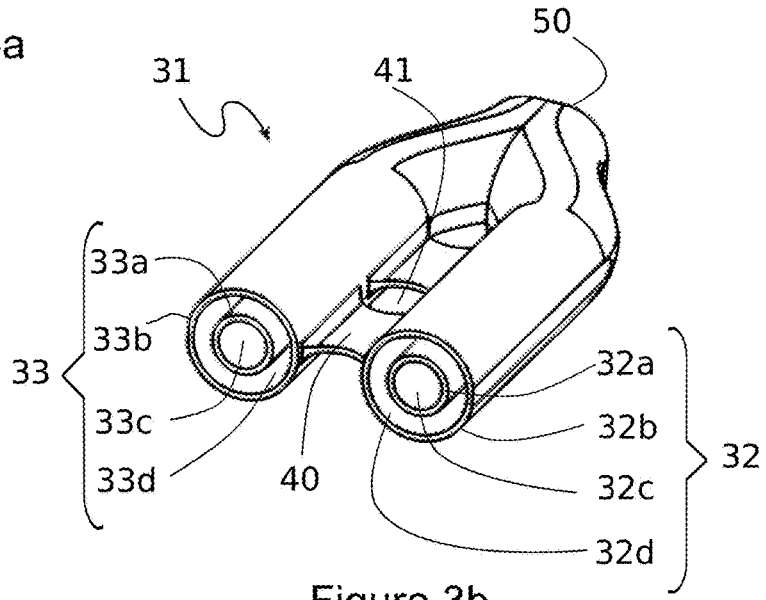

FIG. 3*b* is a schematic rear perspective view of a tube of an exchanger according to one embodiment of the invention.

Figure 4A:
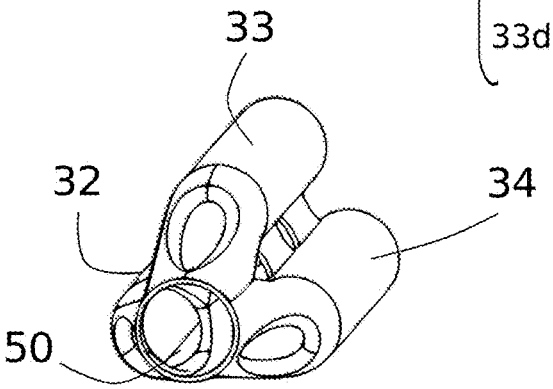

FIG. 4*a* is a schematic front perspective view of a tube of an exchanger according to another embodiment of the invention.

Figure 4B:
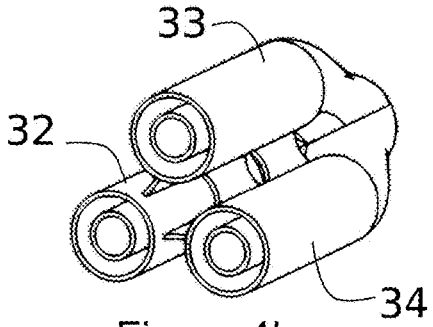

FIG. 4*b* is a schematic rear perspective view of a tube of an exchanger according to another embodiment of the invention.

Figure 5:
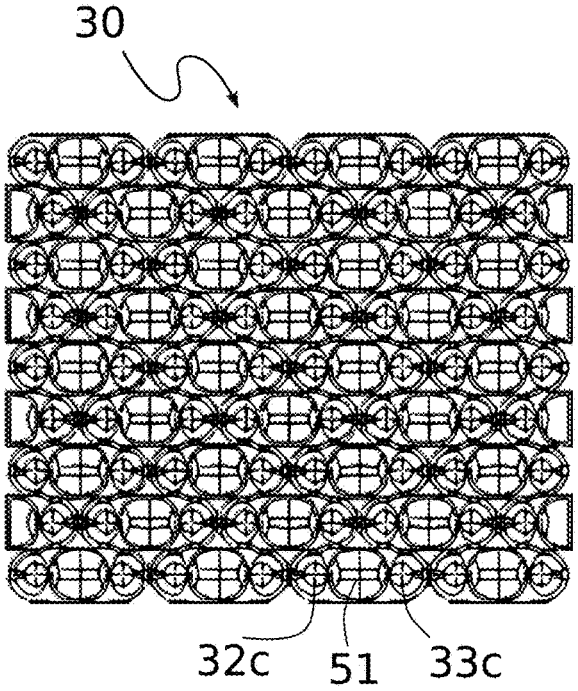

FIG. 5 is a schematic view of a heat exchange matrix of an exchanger according to one embodiment of the invention.

Figure 6:
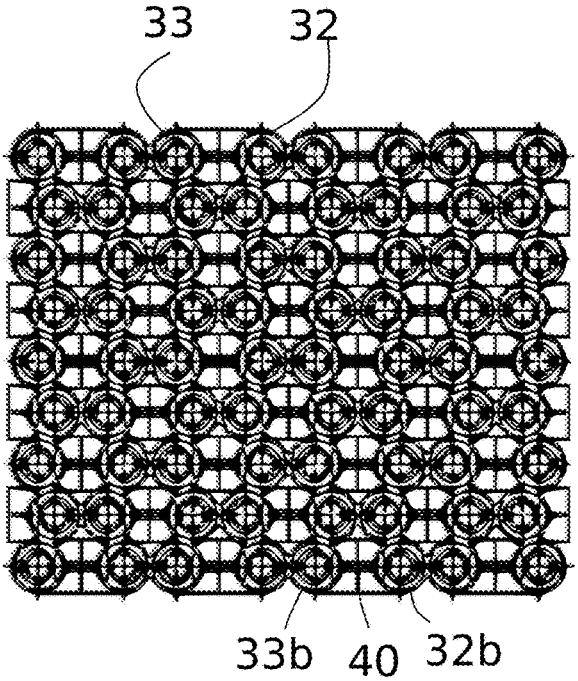

FIG. 6 is a schematic view of a heat exchange matrix of an exchanger according to one embodiment of the invention.

Figure 7:
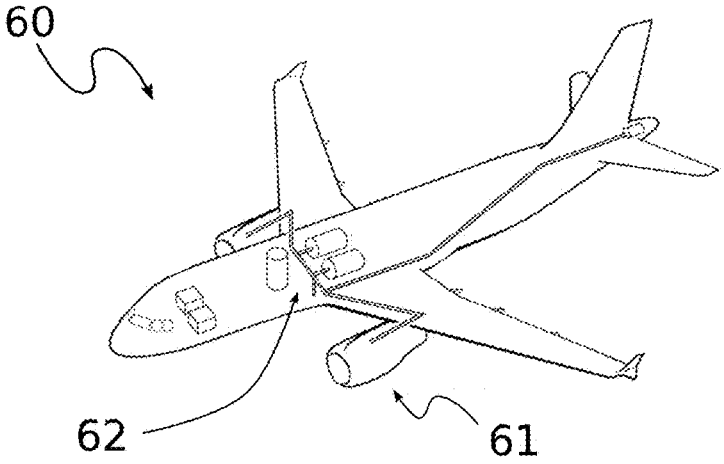

FIG. 7 is a schematic view of an aircraft according to one embodiment of the invention.

DETAILED DESCRIPTION OF ONE EMBODIMENT OF THE INVENTION

For the sake of illustration and clarity, scales and proportions are not strictly adhered to in the figures. In the whole of the detailed description which follows with reference to the figures, unless otherwise indicated, each element of the tubular heat exchanger is described as it is arranged when the exchanger is housed in an air circulation duct which extends along a direction, referred to as longitudinal direction, which coincides with the direction along which the heat exchange tubes of the exchanger extend. This configuration is shown in particular in FIG. 1.

Moreover, identical, similar or analogous elements are denoted using the same reference signs throughout the figures.

Throughout the following, the description considers that the heat exchanger is installed within an air conditioning system, it being understood that the exchanger can be used for applications other than the cooling of a high air temperature, taken, for example, from a propulsion engine of an aircraft.

Figure 1:
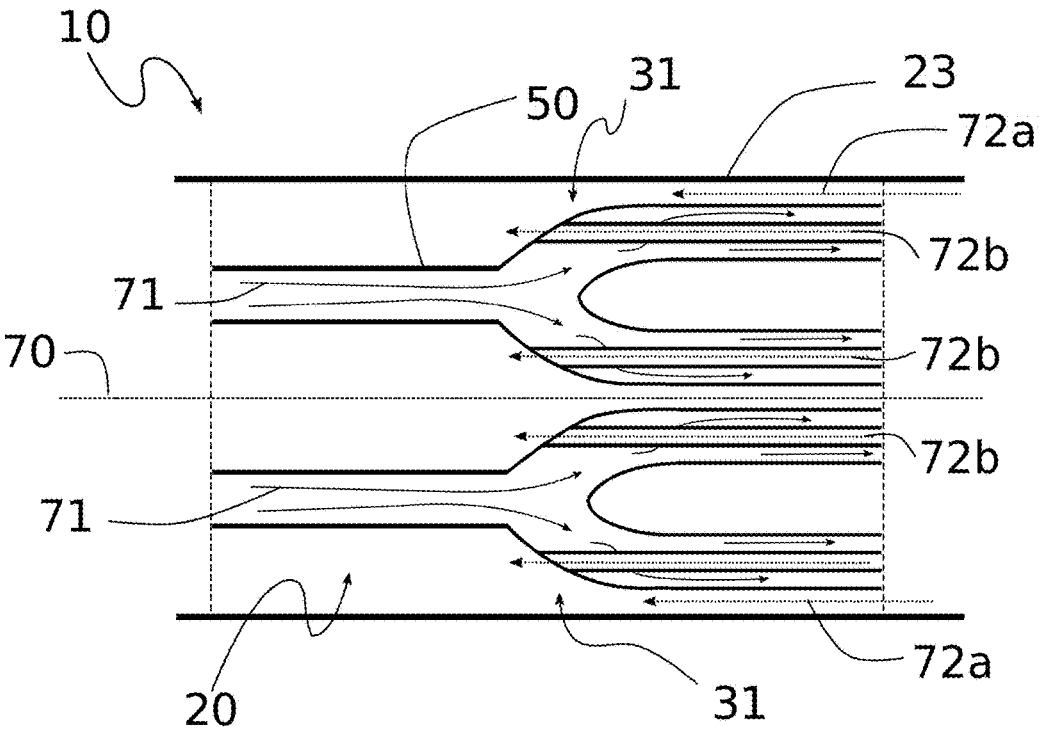
FIG. 1 is a schematic cross-sectional view of an exchanger according to one embodiment of the invention.

FIG. 1 schematically illustrates a tubular heat exchanger 10 embedded in an air circulation duct 23. The exchanger may comprise a casing embedded in the duct 23.

The exchanger 10 further comprises a heat exchange matrix 30, housed in a fluid circulation chamber 20, and formed by a plurality of heat exchange tubes 31 extending in a longitudinal direction 70, which coincides, for example, with the direction along which the duct 23 extends.

The chamber 20 is supplied with air brought to a first temperature. This air is, for example, air taken from outside the aircraft. This fresh air is schematically illustrated by the arrow referenced 72*a* in FIG. 1.

The heat exchange tubes 31 are Y-shaped in the embodiment of FIGS. 2, 3*a*, 3*b*, 5 and 6, the base of the Y forming a distributor 50 for supplying intermediate channels, forming the branches of the Y, with intermediate air brought to a second temperature, different from the temperature of the air supplying the chamber 20. This intermediate air is, for example, hot air taken from the propulsion engines of the aircraft. This hot air is schematically illustrated by the arrow referenced 71 in FIG. 1.

The tubes 31 are also configured to have inner channels supplied with fresh air, which may be the same air as that which supplies the chamber 20. This air is schematically illustrated by the arrow 72*b* in FIG. 1. According to another embodiment, the inner channels can be supplied with air brought to another temperature different from the temperatures of the outside air and of the intermediate air.

Figure 2:
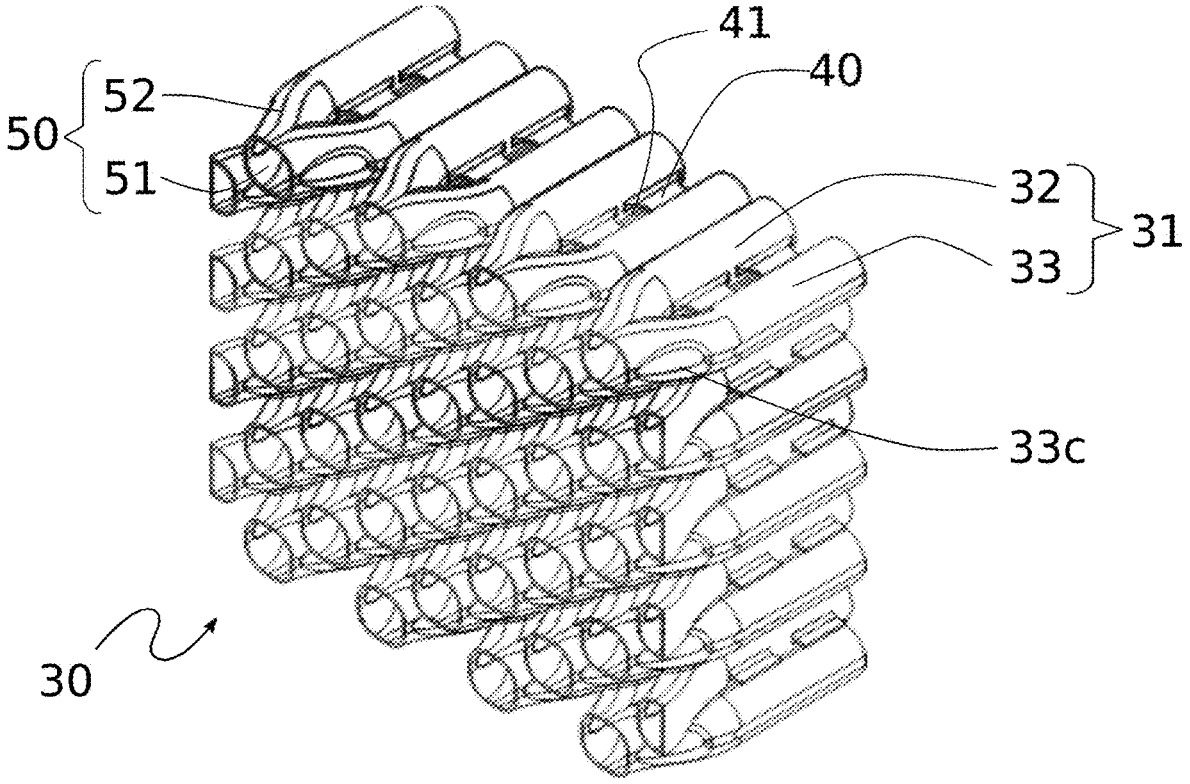
FIG. 2 is a schematic perspective view of a plurality of heat exchange tubes forming the heat exchange matrix of an exchanger according to one embodiment of the invention.

FIG. 2 provides a more detailed illustration of a portion of the heat exchange matrix of an exchanger according to the invention. Each tube comprises two pairs 32; 33 of conjugated concentric ducts connected to an intermediate fluid distributor 50. The distributor 50 comprises an intermediate fluid inlet 51 supplied by a supply system not shown in detail in the figures and two fluid outlets 52 making it possible to supply the intermediate channels 32*d* and 33*d* of the pairs 32; 33 of ducts nested one inside the other. The two pairs 32, 33 of ducts are interconnected by means of a transverse spacer 40 which further comprises an opening 41 allowing the passage of the air circulating in the chamber 20.

FIGS. 3*a* and 3*b* illustrate a Y-shaped tube 31. The Y-shaped tube 31 can be manufactured by an additive printing system, such as a 3D printer.

As illustrated in these figures, the Y-shaped tube 31 comprises two pairs 32; 33 of ducts nested one inside the other, which are also concentric in the embodiment of the figures. Each pair of ducts is formed by two nested ducts, an inner duct 32*a*; 33*a* and an outer duct 32*b*; 33*b*, respectively.

The inner ducts 32*a*; 33*a* delimit an inner channel 32*c*; 33*c* for circulation of the inner air, which is, for example, cold air.

The inter-duct space formed by the inner duct 32*a*; 33*a* and the outer duct 32*b*; 33*b* defines an intermediate channel 32*d*; 33*d* for the circulation of intermediate air, which is, for example, hot air.

The outer duct 32*b*; 33*b* is connected to the two fluid outlets 52 of the distributor 50 so that the intermediate fluid supplying the distributor through the inlet 51 is distributed to the intermediate channels 32*d*; 33*d*.

The inner channel 32*c*; 33*c* of each pair of ducts opens into the fluid circulation chamber 20 so that the air flow circulating in the inner channel is the air flow circulating in the chamber 20. To do this, the outlets 52 of the distributor 50 connected to the outer ducts 32*b*; 33*b* are passed through by the inner duct 32*a*; 33*a*, which opens directly into the fluid circulation chamber 20 so that the chamber 20 and the inner channels are supplied by the same flow of fresh air.

The matrix 30 is formed by Y-shaped tubes 31, the pairs of conjugated concentric ducts 32; 33 of which are parallel to each other. The Y-shaped tubes 31 are combined with each other to form a layer of tubes 31. A plurality of layers can be stacked on top of each other so as to constitute a matrix network of tubes 31 within a chamber 20 to form the matrix 30. The layers of Y-shaped tubes 31 can be stacked so that the inlets 51 of all the distributors 50 are staggered with respect to each other, thus creating spaces for the passage of the outer fluid circulating in the chamber 20.

FIGS. 4*a* and 4*b* illustrate a tube according to another embodiment of the invention. In this embodiment, the tube comprises a distributor 50 and three pairs of nested ducts 32, 33, 34 nested one inside the other. In addition, the distributor 50 supplies the three pairs 32, 33, 34 of ducts in parallel from a single supply of the distributor.

According to other embodiments not shown, a tube may comprise four or more pairs of nested ducts.

In FIG. 5, on either side of the inlet 51 of the distributor 50, one can see the inner channels 32*c* and 33*c* in which the inner fluid circulates which also supplies the chamber 20 in which the heat exchange matrix 30 is housed (not shown in this figure).

FIG. 6 schematically illustrates the pairs of nested ducts 32; 33 and in particular the outer ducts 32*b* and 33*b*, which are interconnected by the transverse spacer 40.

According to this embodiment, the heat exchanger 10 can be integrated into an air conditioning system 62. In addition, the tubes 31 as illustrated are cylindrical and thus make it possible to obtain a cylindrical matrix 30 which can be housed in a chamber 20 delimited by a cylindrical casing, which can be integrated into a cylindrical air circulation pipe and in particular into an air conditioning system 62 equipping an aircraft 60.

As illustrated by FIG. 7, the air conditioning system 62 comprises a hot circuit and a cold circuit intended to supply the tubular exchanger according to the invention. The intermediate fluid is the fluid conveyed by the hot circuit and is, for example, air taken from the propulsion engines 61 of the aircraft. The cold circuit which makes it possible to supply the inner fluid and the outer fluid is, for example, a circuit of air taken from the secondary flow of the engine or air taken from outside the aircraft.

The tubular heat exchanger 10 can be directly embedded in an air circulation pipe, and in particular in an air conditioning system 62 which equips an aircraft 60. According to this embodiment, the size of the exchanger 10 is thus limited while having an increased heat exchange surface with a system of nested ducts allowing a double heat exchange.

The present invention has been described in conjunction with an aeronautical application, in particular for an air conditioning system for an aircraft cabin.

This being the case, a heat exchanger according to the invention can be implemented not only in the context of the air conditioning systems of a transport vehicle, such as an aircraft, but also in all types of cooling systems requiring the cooling of a hot fluid from a hot fluid source by a cold fluid from a cold fluid source.

As such, a heat exchanger according to the invention can equip not only systems as described in application EP3342709 in the applicant's name, but also systems as described in applications EP3190282, WO201634830, EP3392146, WO2018122334, FR2894563 or FR3051894. This list is, of course, not limiting and is only cited to enable a person skilled in the art to perceive the potential for application of a heat exchanger according to the invention.

The invention claimed is:

1. A heat exchanger comprising:

a fluid circulation chamber comprising a fluid inlet and a fluid outlet intended to be supplied with a first fluid, referred to as outer fluid, brought to a first temperature, a heat exchange matrix housed in said circulation chamber and formed by a plurality of heat exchange tubes each comprising at least one pair of ducts nested one inside the other, referred to as inner duct and outer duct, respectively, extending along a direction, referred to as longitudinal direction, and defining:

a channel for the circulation of a fluid, referred to as inner channel, delimited by said inner duct, and suitable for being able to be supplied with a second fluid, referred to as inner fluid, brought to a second temperature, and a channel for the circulation of a fluid, referred to as intermediate channel, delimited by the inter-duct space between said inner duct and said outer duct, and suitable for being able to be supplied with a third fluid, referred to as intermediate fluid, brought to a third temperature, different from said first temperature, wherein at least one heat exchange tube comprises at least two pairs of nested ducts, said pairs being connected to each other by at least one transverse spacer.

2. The heat exchanger according to claim 1, wherein at least one heat exchange tube comprises at least two pairs of nested ducts, said intermediate channels of which are supplied by an intermediate fluid distributor.

3. The heat exchanger according to claim 2, wherein at least one inner duct of at least one pair of nested ducts passes through said intermediate fluid distributor.

4. The heat exchanger according to claim 3, wherein at least one inner duct of at least one pair of nested ducts passes through said intermediate fluid distributor and opens into said circulation chamber.

5. The heat exchanger according to claim 1, wherein at least one transverse spacer comprises at least one opening configured to allow the passage of said outer fluid between said pairs of nested ducts connected by this spacer in a direction having an angle of between 0° and 90° with respect to said longitudinal direction.

6. The heat exchanger according to claim 1, wherein at least one heat exchange tube comprises at least one pair of nested ducts, the ducts of which are connected to one another by a connecting rod which extends in the intermediate channel between the inner duct and the outer duct.

7. The heat exchanger according to claim 1, wherein at least one heat exchange tube comprises at least one pair of nested cylindrical ducts.

8. The heat exchanger according to claim 1, wherein, characterized in that at least one heat exchange tube comprises at least one pair of concentric nested ducts.

9. The heat exchanger according to claim 1, wherein it further comprises a casing housing said heat exchange tubes, said casing delimiting the fluid circulation chamber.

10. A system for cooling a fluid exhibiting a first temperature, referred to as hot fluid, with a fluid exhibiting a second temperature, referred to as cold fluid, comprising a hot fluid circuit suitable for being able to be supplied with hot fluid by a hot fluid source, and a cold fluid circuit suitable for being able to be supplied with cold fluid by a cold fluid source, wherein said system further comprises a heat exchanger comprising:

a fluid circulation chamber comprising a fluid inlet and a fluid outlet intended to be supplied with a first fluid, referred to as outer fluid, brought to a first temperature, a heat exchange matrix housed in said circulation chamber and formed by a plurality of heat exchange tubes each comprising at least one pair of ducts nested one inside the other, referred to as inner duct and outer duct, respectively, extending along a direction, referred to as longitudinal direction, and defining:

a channel for the circulation of a fluid, referred to as inner channel, delimited by said inner duct, and suitable for being able to be supplied with a second fluid, referred to as inner fluid, brought to a second temperature, and a channel for the circulation of a fluid, referred to as intermediate channel, delimited by the inter-duct space between said inner duct and said outer duct and suitable for being able to be supplied with a third fluid, referred to as intermediate fluid, brought to a third temperature, different from said first temperature, wherein at least one heat exchange tube comprises at least two pairs of nested ducts said pairs being connected to each other by at least one transverse spacer, said hot circuit supplying said intermediate channels and said cold circuit supplying said inner channels and said circulation chamber of said exchanger.

11. The cooling system according to claim 10, wherein said intermediate channels and said inner channels are supplied counter-currently by said hot and cold fluids, respectively.

12. An air conditioning system of a cabin of a transport vehicle comprising at least one air cooling system for cooling a fluid exhibiting a first temperature, referred to as hot fluid, with a fluid exhibiting a second temperature, referred to as cold fluid, comprising a hot fluid circuit suitable for being able to be supplied with hot fluid by a hot fluid source, and a cold fluid circuit suitable for being able to be supplied with cold fluid by a cold fluid source, the system further including a heat exchanger comprising:

a fluid circulation chamber comprising a fluid inlet and a fluid outlet intended to be supplied with a first fluid, referred to as outer fluid, brought to a first temperature, a heat exchange matrix housed in said circulation chamber and formed by a plurality of heat exchange tubes each comprising at least one pair of ducts nested one inside the other, referred to as inner duct and outer duct, respectively, extending along a direction, referred to as longitudinal direction, and defining:

a channel for the circulation of a fluid, referred to as inner channel, delimited by said inner duct, and suitable for being able to be supplied with a second fluid, referred to as inner fluid, brought to a second temperature, and a channel for the circulation of a fluid, referred to as intermediate channel, delimited by the inter-duct space between said inner duct and said outer duct and suitable for being able to be supplied with a third fluid, referred to as intermediate fluid, brought to a third temperature, different from said first temperature, wherein at least one heat exchange tube comprises at least two pairs of nested ducts said pairs being connected to each other by at least one transverse spacer said hot circuit supplying said intermediate channels and said cold circuit supplying said inner channels and said circulation chamber of said exchanger.

* * * * *